US011161028B2

(12) United States Patent
Foster

(10) Patent No.: US 11,161,028 B2
(45) Date of Patent: Nov. 2, 2021

(54) ELECTRONIC DOWN AND DISTANCE MARKER SYSTEM

(71) Applicant: James Michael Foster, Raytown, MO (US)

(72) Inventor: James Michael Foster, Raytown, MO (US)

( * ) Notice: Subject to any disclaimer, the term of this patent is extended or adjusted under 35 U.S.C. 154(b) by 152 days.

(21) Appl. No.: 16/361,108

(22) Filed: Mar. 21, 2019

(65) Prior Publication Data

US 2019/0290992 A1 Sep. 26, 2019

Related U.S. Application Data

(60) Provisional application No. 62/646,825, filed on Mar. 22, 2018.

(51) Int. Cl.
*A63B 71/06* (2006.01)

(52) U.S. Cl.
CPC ..... *A63B 71/0619* (2013.01); *A63B 2220/12* (2013.01); *A63B 2220/89* (2013.01); *A63B 2225/50* (2013.01); *A63B 2243/007* (2013.01)

(58) Field of Classification Search
None
See application file for complete search history.

(56) References Cited

U.S. PATENT DOCUMENTS 3,300,861 A 1/1967 Lilly
4,090,708 A * 5/1978 McPeak ..... A63C 19/08 33/289
4,837,957 A 6/1989 Egender
6,907,840 B1 6/2005 Gaines
7,770,297 B1 8/2010 Sommerfeld
8,220,170 B1 * 7/2012 Winckler ..... G01C 15/004 33/289
2001/0040671 A1 * 11/2001 Metcalf ..... G03B 37/04 353/94
2002/0089674 A1 * 7/2002 Lee ..... A63B 71/0605 356/614
2004/0111903 A1 6/2004 Amron
2004/0200082 A1 10/2004 Dinicola
2005/0143199 A1 6/2005 Saroyan
2006/0128503 A1 6/2006 Savarese et al.
2008/0184571 A1 8/2008 Kivley
2008/0256811 A1 10/2008 Garza
2009/0267748 A1 * 10/2009 Bailey ..... A63B 71/0669 340/323 R (Continued)

*Primary Examiner* — Kevin Y Kim
(74) *Attorney, Agent, or Firm* — Husch Blackwell LLP

(57) ABSTRACT

An electronic down and distance marker system that may comprise a first marker, a second marker connected to a first marker by a physical member having a distance of about ten yards, and a down marker. The present system may include a measurement device for measuring a linear distance between the down marker and the second marker and one or more electronic displays disposed on one of the down marker and the second marker that may display a down and/or the measured linear distance between the down marker and the second marker. A light projector may project one or more of a line of light corresponding to the line to gain, and/or a shape to optically mark the line to gain on the sideline. A remote control, camera and/or an improved wireless measurement and communications capability may also be incorporated into the present system.

16 Claims, 5 Drawing Sheets

(56) References Cited

U.S. PATENT DOCUMENTS

| | | | | |
|---|---|---|---|---|
| 2010/0236115 | A1 | 9/2010 | Gaetano | |
| 2011/0130228 | A1* | 6/2011 | Amron ..... | A63C 19/065<br>473/490 |
| 2013/0120581 | A1 | 5/2013 | Daniels et al. | |
| 2013/0266918 | A1 | 10/2013 | Tinjust | |
| 2015/0065271 | A1 | 3/2015 | Peterson | |

* cited by examiner

ELECTRONIC DOWN AND DISTANCE MARKER SYSTEM

CROSS-REFERENCE TO RELATED APPLICATION

This application claims priority to U.S. Provisional Patent Application No. 62/646,825 filed on Mar. 22, 2018 to James Michael Foster, the entire disclosure of which is incorporated herein by reference

FIELD OF THE INVENTION

This present invention relates to a system for measuring, marking, and communicating the down and distance for first downs used in American football to improve the functionality and the overall experience of the game. The system of the present invention includes a plurality of markers, a distance measurement component, and an electronic display and a number of improvements which increase the functionality and interaction of the equipment with the players, referees, and fans. The present system may also include additional features for communicating the information throughout the stadium for display to participants, attendees, and coaching staffs.

BACKGROUND OF THE INVENTION

There are a number of needs in the art related to the features and functionalities of the existing down and distance markers used in professional, college, high school, and youth football leagues. For instance, the existing technology does not provide any visual indicator in relation to a football which would indicate whether a first down is made when it is hard to visually determine. Further, existing line-to gain indicators are plastic or vinyl sheets placed on the ground and this poses a hazard to players. There have been numerous notable injuries due to players slipping on these existing line-to gain markers placed on the sidelines. Moreover, there is little to no real-time communication between the down and distance marker system and other displays on the field or in the stadium. Further, there is no remote operation of existing down and distance marker systems.

As such, there is a need in the art for an American football down and distance marker system that provides real-time and accurate information to the officials, television audience and players related to marking and indicating the line to gain when verifying whether a first down was made on the field. There is a further need in the art for an American football down and distance marker system that provides broadened communication with other parts of the stadium and or the audience. There is further need in the art to improve safety through the use of a line to gain sideline marker that does not change the surface of the field or prevent a player's cleats from gripping the field. There is a further need in the art to improve the features and functionalities to provide more convenient operation of existing down and distance marker system, and to improve the experience of the game by players, coaches, spectators, fans, and television audiences.

SUMMARY OF THE INVENTION

The present invention relates to an electronic down and distance marker system that may include a first marker and a second marker connected to a first marker by a physical member having a distance of about ten yards. The present system also includes a down marker for marking the location of the ball on the field relative to the first and second marker on any given play. In one embodiment, a light projector may be operably connected to the second marker for projecting optical light to identify a line of gain. The light projector may project a line of light corresponding to the line to gain relative to the second marker to determine whether a ball has crossed the line of gain for determining whether a first down was achieved. In another embodiment, the light projector may project a shape having a determinable width and length onto a playing surface on the sideline to optically mark the line to gain on the sideline as a reference to players and officials during play. This optical line to gain on the sidelines does not alter the playing surface and may be significantly safer that existing systems. In one embodiment, the light shape is an arrow shape.

In another embodiment, the electronic down and distance marker system may include a camera for recording a field level perspective video angle mounted on one of the down marker, the first marker or the second marker. The camera may include a fish-eye lens, but any camera and lens type is within the scope of the present invention.

In one embodiment, the electronic down and distance marker system may also incorporate one or more electronic displays disposed on one of the down marker and the second marker, the one or more displays including a down indicator and a distance indicator, and a remote control unit allowing an operator to remotely control the one or more electronic displays.

The electronic down and distance marker system may further comprise an embodiment that includes a first marker, a second marker connected to a first marker by a physical member having a distance of about ten yards, and a related down marker. A measurement device for measuring a linear distance between the down marker and the second marker may be included, and one or more electronic displays disposed on one of the down marker and the second marker, wherein the one or more displays include a down indicator and a distance indicator and the distance indicator in communication with the measurement device to display the linear distance between the down marker and the second marker. Finally, a camera for recording a field level angle mounted on the down marker may be included.

In one embodiment, the electronic down and distance marker system may include a remote control unit that allows an operator to remotely control the one or more electronic displays or other functionalities of existing down and distance marker systems.

In another embodiment, the electronic down and distance marker system may comprise a first marker, a second marker connected to a first marker by a physical member having a distance of about ten yards, and a down marker. This embodiment may include a measurement device for measuring a linear distance between the down marker and the second marker and one or more electronic displays disposed on one of the down marker and the second marker. The one or more displays may include a down indicator and a distance indicator, and the distance indicator may be in communication with the measurement device to display the linear distance between the down marker and the second marker. This embodiment may include a light projector operably connected to the second marker for projecting a line of optical light to provide a visual indication and reference of a line of gain. In one embodiment, the light projector may project one or more of a line of light corresponding to the line to gain relative to the second marker to determine whether a ball has crossed the line of gain, and a shape having a determinable width and length onto a playing surface on the sideline to optically mark the line to gain on the sideline.

Other aspects and advantages of the present invention will be apparent from the following detailed description of the preferred embodiments and the accompanying drawing figures.

BRIEF DESCRIPTION OF THE SEVERAL VIEWS OF THE DRAWINGS

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
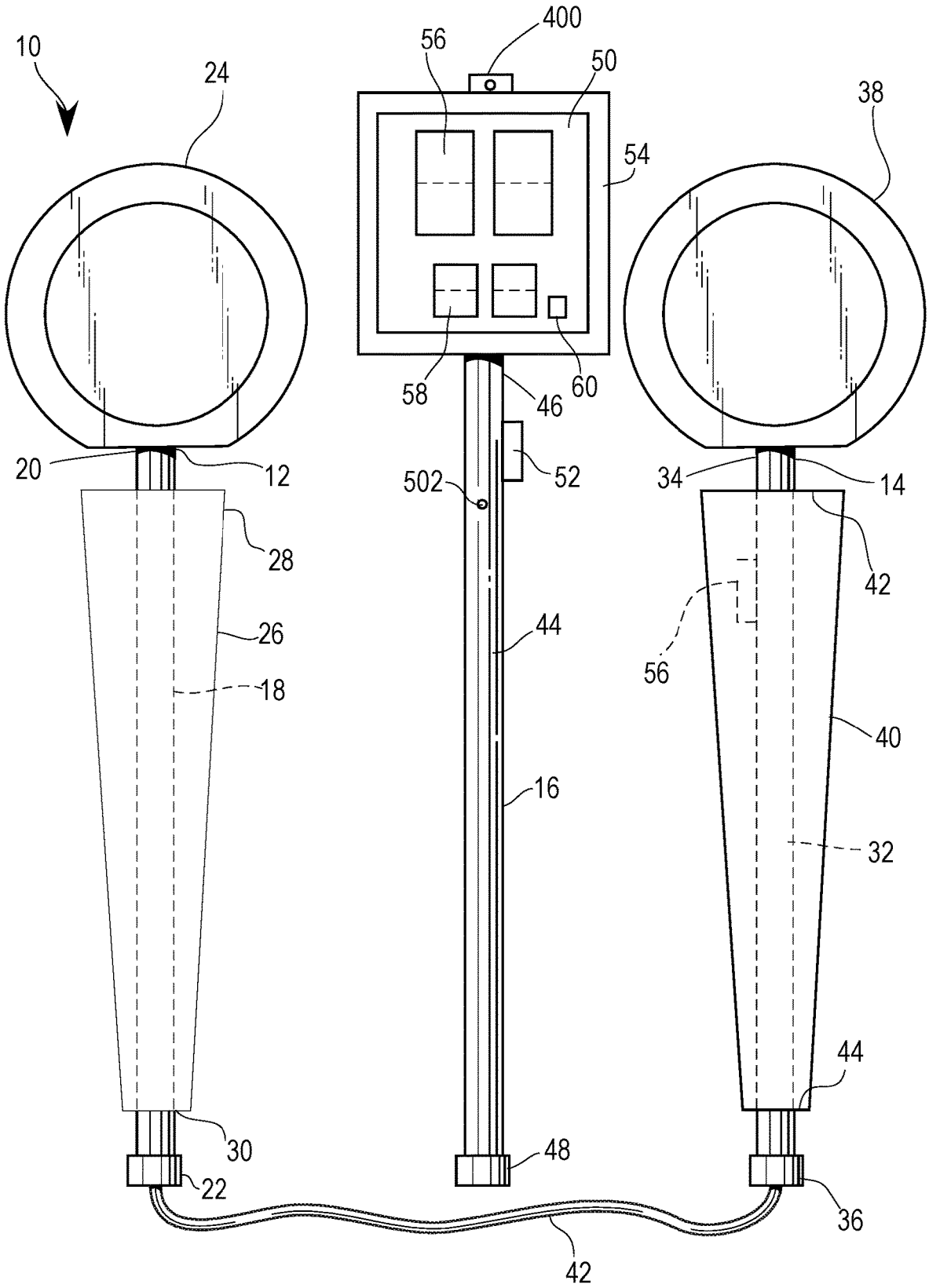
FIG. 1 is a schematic front view of one embodiment of a down and distance marker system in accordance with the teachings of the present disclosure.

The present invention is directed to a down and distance marker system 10 that improves on existing down and distance marker systems by including a distance measurement system coupled to an electronic display which conveys not only the down, but also the measured distance to obtain a first down. Accordingly, as shown in FIG. 1, the present down and distance marker system 10 includes a first marker 12 for indicating the original line of scrimmage of the first down, a second marker 14 operably connected to said first marker at a fixed distance of ten (10) yards, and a down marker 16 which is independent of first marker 12 and second marker 14 which is used to mark the exact position of the football on the field for any given down. The system is described in U.S. patent application Ser. No. 14/211,906, the entire disclosure of which is incorporated herein by reference. As shown in FIG. 1, down marker 16 includes a display 50 and display housing 54 containing the display mounted at a top end 46 of marker 16.

Another embodiment of the electronic down and distance system 10 is improved with additional wireless connectivity between down and distance marker 16 and a scoreboard or other stadium display. As shown in FIG. 1, either the down and/or distance marker 16 or other marker 12 or 14 would be equipped with a measuring device 52 may also include a wireless transmitter (e.g. 2.4 Hz Spread Spectrum or other known frequency or method) capable of communicating the current down, distance to a first down, and unit of measurement (e.g. yard, foot, inch) to a remote scoreboard and/or other connected device capable of processing the information for users/fan experience. This system may include an antenna, data transceiver, and microprocessor circuit within the measuring device 52. A dedicated communication link could also be designed between the down and distance marker 16 or other markers 12, 14 for the purpose of sending control data between the two units. This measuring device 52 and associated wireless transmitter may also be used for this purpose in addition to providing the linear distance between markers 14 and 16.

In one example, the down marker 16 would act as the master unit and send instructions to the distance display 50 (a slave unit). When the user presses the "down advance" button 502 on the down marker 16, the master unit sends the new down to the slave unit and also an instruction to measure the distance from down marker to line to gain. The slave unit then initiates the measurement device to measure distance between markers 14 and 16 and display the distance on display 50 and/or transmits the data (down, distance, unit) to the remote scoreboard for display.

Measurement device 52 determines the linear distance between down marker 16 and second marker 14. Measurement device 52 may be a sonic or light-based (laser) distance measurement device and may work in conjunction with a sensor 56 attached to rod 32 of second marker 14 when measurement device 52 is on down marker 16 or sensor 56 may be attached to down marker 16 when measurement device 52 is on second marker 14. For the present disclosure, a sonic distance measurement device includes RF signal technology and or other radio or electromagnetic wave signals. Measurement device 52 may also include any other known wireless distance measurement technology.

In another embodiment, the display 50 of down marker 16 could include a display of a message to fans or viewers, including advertisements and recognition of sponsors, or other pertinent information that could selectively display content. In another embodiment, flags 24 and 38 of markers 12 and 14 could also include an electronic display (like display 50) and display messages or other items of information.

FIG. 1 illustrates an embodiment of the present down and distance marker system that includes a camera 400 mounted on down marker 16, or markers 12 or 14, to broadcast and/or record plays from an on-field perspective. In one embodiment, camera 400 is a digital camera mounted on the on the down marker 16 that faces the field of play. In one embodiment, camera 400 is in communication with a memory for storing the video file. In one embodiment, the memory is designed to record the last six plays from scrimmage. For example, when the seventh play is recorded, the first play is removed. Further, when the eighth play is recorded, the second play is deleted removed and so on in a first-in-firstout sequence. However, the camera may stream or live cast a video feed, or have a memory configured to store any number of plays.

One embodiment of the video recording system may include a digital fish-eye camera 400, memory storage/retrieval, microprocessor, power supply, Wi-Fi access point, and high data rate transmitter. The fish-eye camera provides a wide angle view of the field, however, any digital camera configuration could be used. The camera may be controlled by a remote control unit (described below) either on the sideline, press box, or other remote location. There may also be a housing on the sideline connected to AC power that could serve as one or more of the Wi-Fi connection point for the camera, the data storage/retrieval module, and wireless connection to the down marker 16 and remote control interface. This remote "server" could provide additional memory storage for any number of plays—possibly an entire game. This "server" could also be accessed by network television systems to be integrated into telecasts.

Figure 2A:
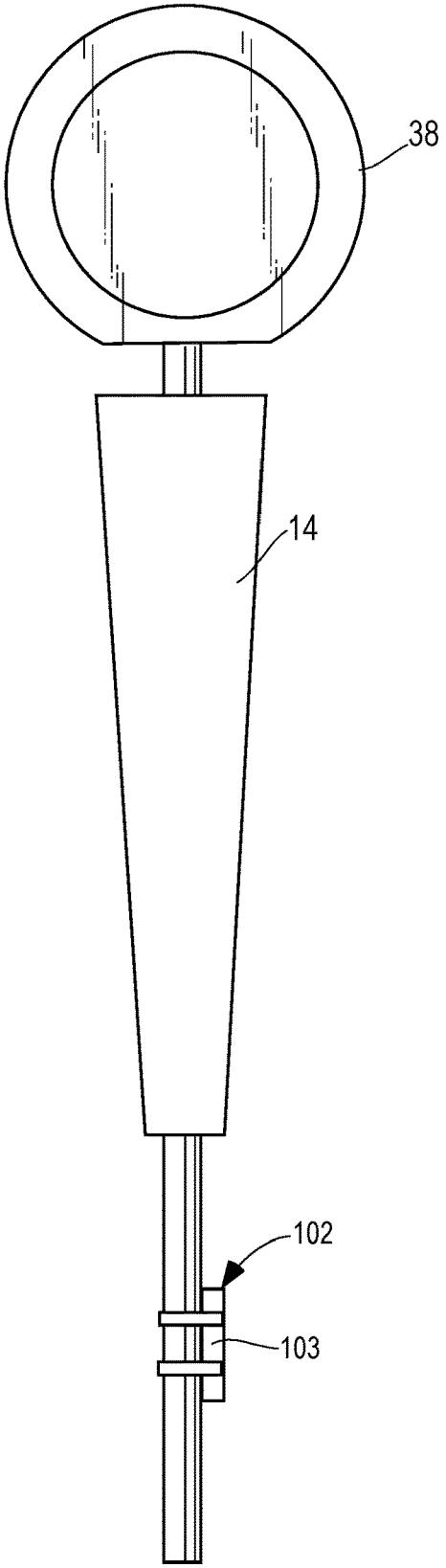
FIG. 2A is a schematic front view of one embodiment of a line to gain identification system of a down and distance marker system in accordance with the teachings of the present disclosure.
Figure 2B:
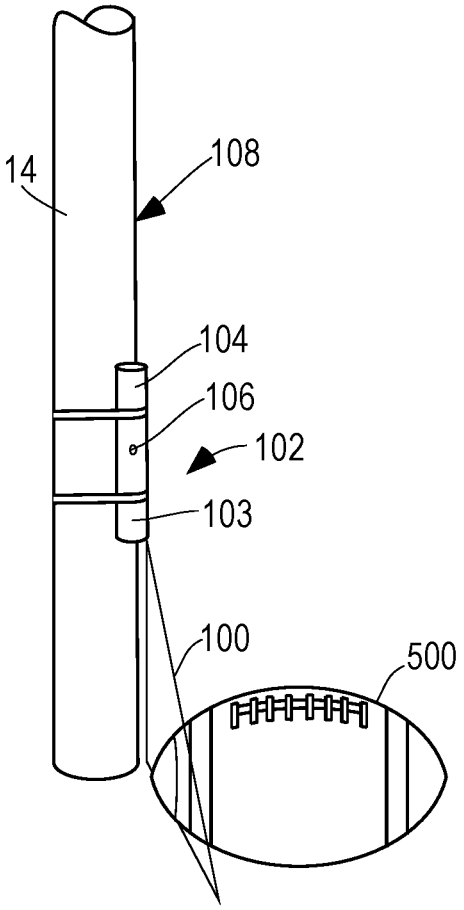
FIG. 2B is a schematic partial front view of the embodiment of the line to gain identification system of the down and distance marker system of FIG. 2A.
Figure 2C:
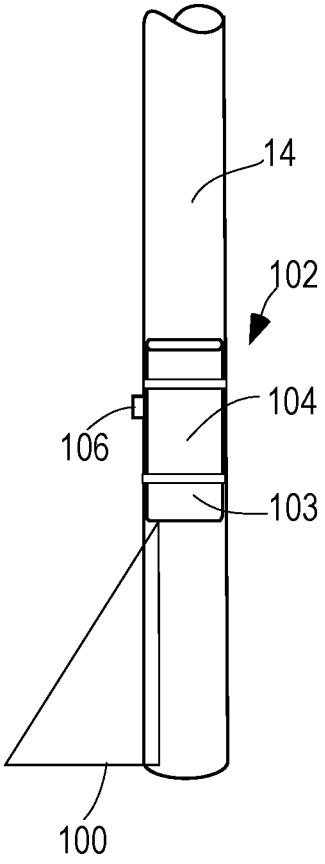
FIG. 2C is a schematic partial side view of the embodiment of the line to gain identification system of the down and distance marker system of FIG. 2A.

FIGS. 2A-2C illustrates a feature that is included in the second marker 14. Second marker 14 includes a projected laser line 100 from a line to gain identification system 102 that corresponds to the football line to gain. The football line to gain marks the point on the football field at which the offense can obtain a first down—also referred to herein as the line to gain. In one embodiment, a laser or other light source will be in a projector 103 having a housing 104 with an included battery source (not shown) and on/off control 106. The line to gain identification system 102 may be mounted on the line to gain marker 14. Alternatively, an embodiment (not shown) includes the projector being attached to the down marker housing 54 or marker 16. Line to gain identification system 102 may be mounted on rod 32 to ensure that the line to gain identification system 102 is placed to exact placement of the projected laser line 100. The projected laser line 100 will be disposed perpendicular to inner edge 108 of the pole 14 (inner edge is closest to marker 12) and, in one embodiment, may extend outwardly from the rod 32 as shown in FIG. 2C. In one embodiment, the projected line extends around approx. 4-6" in length from the rod 32. However, any distance that provides a sufficient length to allow the projected line 100 to project onto a football if it passes the line to gain is within the scope of the present invention. Markers 14 or 16 may also include a mechanism, device, or method for ensuring that the projected laser line 100 is perpendicular to the sidelines, such as square indicator, a bubble level or other known device.

In use, if there is a question as to whether the offense has passed the line to gain, the ball is spotted and placed on the surface of field. The second marker 14 is brought from the sideline and positioned to identify the point on the field that corresponds to the line to gain. As shown in FIG. 2B, the projected laser line 100 can then be projected downward to project a line that extends 4-6 inches away from pole 14. As shown in FIG. 2B, if the projected laser line 100 appears on the ball 500, then the offense has passed the line to gain and has obtained a first down.

FIG. 3 shows another embodiment wherein the second marker 14 may include an optical line to gain projector 150 for projecting an arrow stripe 152 displaying a visual indicator of the line to gain on the ground which may typically be activated on the sideline to provide the players a visual indication of the line to gain during play. In one embodiment, second marker 14 includes a projector 150 that projects an amber color stripe 152 on the sideline that replaces the vinyl arrow currently used. However, any color could be used. The vinyl products in use today can be a safety hazard to athletes who are trying to decelerate while approaching the sideline as the vinyl has less friction than the turf and will prevent the foot of the player from gripping into the turf. There have been many notable injuries attributed to players slipping on the current sideline markers which are placed on top of the playing surface. The visual arrow projects onto, and does not change the playing surface experienced by the players and eliminates this hazard.

Figure 3A:
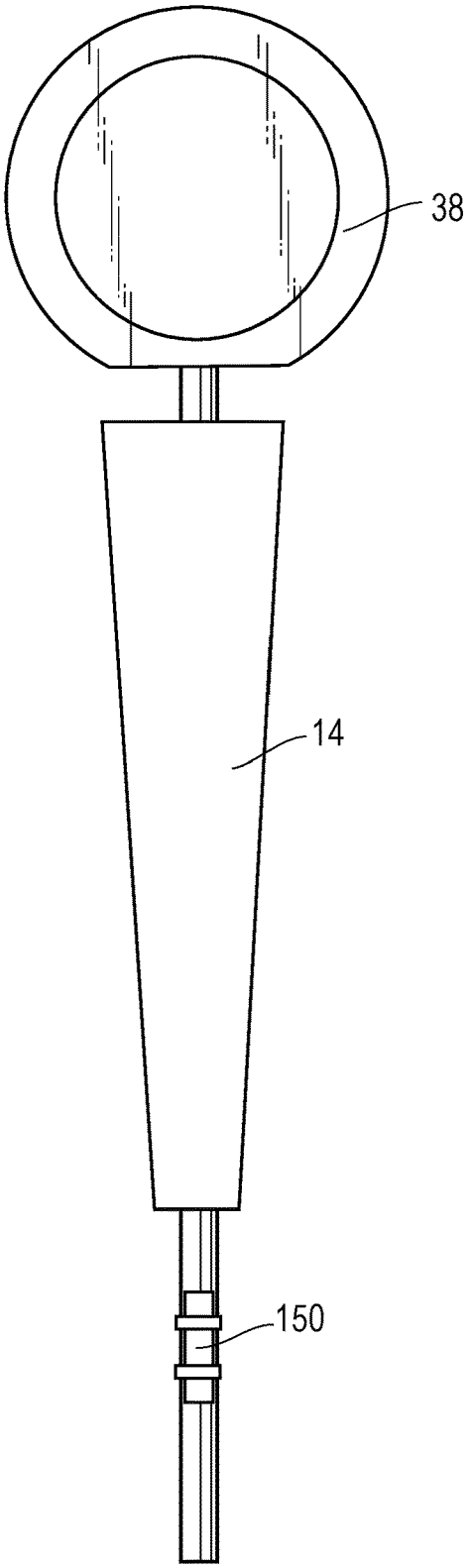
FIG. 3A is a schematic front view of one embodiment of line to gain identification system of a down and distance marker system in accordance with the teachings of the present disclosure.
Figure 3B:
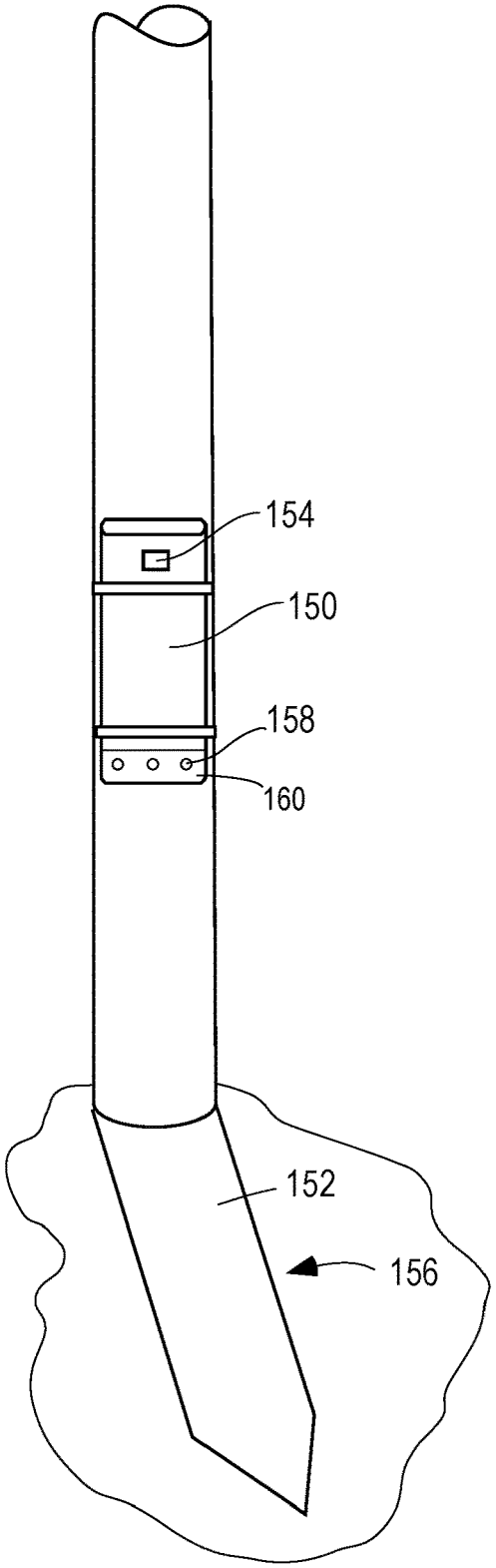
FIG. 3B is a schematic partial front view of the embodiment of the line to gain identification system of the down and distance marker system of FIG. 3A.

As shown in FIGS. 3A and 3B, the projector 150 may similarly be mounted to the second marker 14 pole or integrated into the distance marker 16. The optical line to gain projector unit 150 will be comprised of one or more of a high power light source (e.g. amber colored LEDs) 158, optic lens 160 for light shaping, rechargeable battery source disposed within the unit, a charger adapter port, and on/off power control 154. When power is applied, the light source 158 will generate a light that travel through the optic lens 160, which will shape the light beam to form an arrow display on the ground surface 156. In one embodiment, the line to gain projector 150 and the line to gain identification projector 103 could be combined into one unit with the same light source and the line-type being controllable by the operator and a selective application of the lens applied to the light source. In one embodiment, the optic lens 160 could be in an overlapped position such that the line to gain identification line could always be projected, with the larger arrow being selectively turned on and off over the identification line. This arrangement would provide efficiencies in using the same light and power sources.

Figure 4:
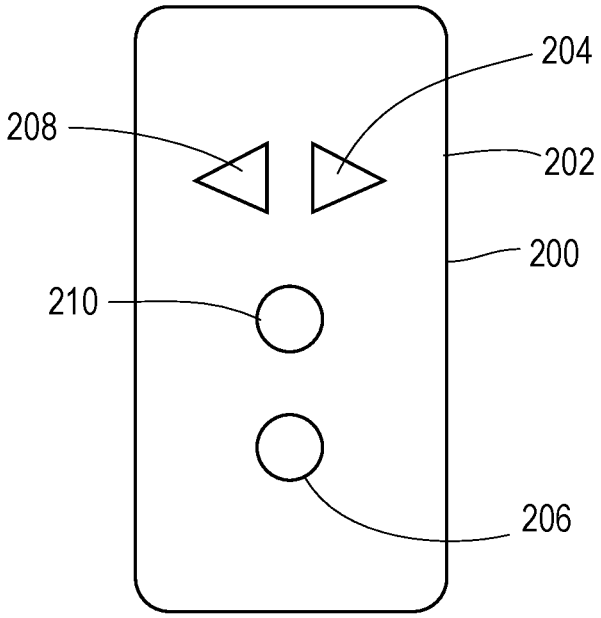
FIG. 4 is a top schematic view of one embodiment of a remote control of a down and distance marker system in accordance with the teachings of the present disclosure.

FIG. 4 illustrates a remote control unit 200 for operating the present down and distance system 10. Remote control unit 200 may include a housing 202, an advance button 204, an on/off button 206. In one embodiment, remote control unit may also include a reverse button 208 and a display change button 210 to change the display from the down and/or distance indicator to an informational display described above. In one embodiment, remote control unit 200 may comprise a keyfob-like device or other remote of similar size to advance down and distance displayed on the display 50 of marker 16. In order to provide a more convenient method for activating the "Down Advance" operations, the remote control 200 can be used. For example, in very cold or inclement weather, the official could keep his hand in his pocket and still operate the down marker 16 by using the remote control 200 and press the advance button 204 to wirelessly control the advancement of the downs on display 50 of marker 16. In one embodiment, the remote control 200 may be a low data rate transmitter circuit, microprocessor, and power supply. However, other known wireless signal/remote control systems are within the scope of the present invention. In a basic embodiment, a single button 204 on the remote 200 may be implemented (with possibility of adding additional buttons for enhanced functions) and when pressed would send a control signal to the down marker 16 providing for down advance on the display 50 of marker 16. However, any functions performed by the present down and distance system 10 may also be connected to such remote control 200.

In one embodiment, the operation of projectors 103 and/or 150 described above may be controlled by such remote control unit. Further, remote control 200 may also the operation of control camera 400

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

I claim:

1. An electronic down and distance marker system comprising:

a first marker;

a second marker connected to the first marker by a physical member having a distance of ten yards, wherein said second marker has a first end and a second end defining a longitudinal axis of said second marker, said second end configured for contacting a ground surface;

a down marker;

a light projector operably connected to the second marker for projecting optical light to identify a line of gain, wherein said light projector is projected in a direction parallel to the longitudinal axis of said second marker and directed toward said second end to project optical light on said ground surface immediately adjacent to the second marker.

2. The electronic down and distance marker system of claim 1, wherein the light projector projects a line of light corresponding to the line to gain relative to the second marker to determine whether a ball has crossed the line of gain.

3. The electronic down and distance marker system of claim 1, wherein the light projector projects a shape having a determinable width and length onto a playing surface on said sideline to optically mark the line to gain on the sideline.

4. The electronic down and distance marker system of claim 3 wherein the shape is an arrow.

5. The electronic down and distance marker system of claim 1 further comprising a camera for recording a field level angle mounted on one of said down marker, said first marker or said second marker.

6. An electronic down and distance marker system of claim 5 where the camera includes a fish-eye lens.

7. An electronic down and distance marker system of claim 1 further comprising one or more electronic displays disposed on one of said down marker and said second marker, said one or more displays including a down indicator and a distance indicator, and a remote control unit allowing an operator to remotely control the one or more electronic displays.

8. An electronic down and distance marker system comprising:

a first marker;

a second marker connected to the first marker by a physical member having a distance of ten yards, wherein said second marker has a first end and a second end defining a longitudinal axis of said second marker, said second end configured for contacting a ground surface;

a down marker;

a measurement device for measuring a linear distance between said down marker and said second marker;

one or more electronic displays disposed on one of said down marker and said second marker, said one or more displays including a down indicator and a distance indicator, said distance indicator in communication with said measurement device to display said linear distance between said down marker and said second marker; and a light projector operably connected to the second marker for projecting optical light to identify a line of gain, wherein said light projector is projected in a direction parallel to the longitudinal axis of said second marker and directed toward said second end to project optical light on said ground surface immediately adjacent to the second marker.

9. The electronic down and distance marker system of claim 8, wherein the light projector projects a line of light corresponding to the line to gain relative to the second marker to determine whether a ball has crossed the line of gain.

10. The electronic down and distance marker system of claim 8, wherein the light projector projects a shape having a determinable width and length onto a playing surface on said sideline to optically mark the line to gain on the sideline.

11. The electronic down and distance marker system of claim 10 wherein the shape is an arrow.

12. The electronic down and distance marker system of claim 8, wherein the light projector projects both a line of light corresponding to the line to gain relative to the second marker to determine whether a ball has crossed the line of gain, and a shape having a determinable width and length onto a playing surface on said sideline to optically mark the line to gain on the sideline.

13. The electronic down and distance marker system of claim 8, further comprising a camera for recording a field level view mounted on said down marker.

14. The electronic down and distance marker system of claim 8, further comprising a remote control unit allowing an operator to remotely control the one or more electronic displays.

15. The electronic down and distance marker system of claim 8, further comprising a wireless transmitter that communicates one of the current down, distance to a first down, or a unit of measurement for the distance to at least one of a remote scoreboard and a connected device.

16. An electronic down and distance marker system comprising:

a first marker;

a second marker connected to the first marker by a physical member having a distance of ten yards, wherein said second marker has a first end and a second end defining a longitudinal axis of said second marker, said second end configured for contacting a ground surface;

a down marker;

a light projector operably connected to the second marker for projecting optical light to identify a line of gain, wherein said light projector is projected downward on said ground surface immediately adjacent to said second marker, and wherein said line of gain is orientated in a direction perpendicular to a line defined between said first marker and said second marker.

* * * * *